US008646184B2

(12) United States Patent
Westerfield

(10) Patent No.: US 8,646,184 B2
(45) Date of Patent: Feb. 11, 2014

(54) DUAL TAPER RELEASE BUTTON FOR FOLDING KNIFE

(75) Inventor: James Westerfield, Oregon City, OR (US)

(73) Assignee: Mentor Group, L.L.C., Oregon City, OR (US)

( * ) Notice: Subject to any disclaimer, the term of this patent is extended or adjusted under 35 U.S.C. 154(b) by 136 days.

(21) Appl. No.: 13/347,042

(22) Filed: Jan. 10, 2012

(65) Prior Publication Data

US 2013/0125403 A1 May 23, 2013

Related U.S. Application Data

(60) Provisional application No. 61/560,914, filed on Nov. 17, 2011.

(51) Int. Cl.
*B26B 3/06* (2006.01)

(52) U.S. Cl.
USPC ..... 30/155; 30/160; 30/161

(58) Field of Classification Search
USPC ..... 30/161, 159, 160, 342, 337, 338, 155
See application file for complete search history.

(56) References Cited

U.S. PATENT DOCUMENTS

| | | | | | |
|---|---|---|---|---|---|
| 4,240,201 | A * | 12/1980 | Sawby et al. | ..... | 30/161 |
| 5,822,866 | A * | 10/1998 | Pardue | ..... | 30/161 |
| 5,979,065 | A * | 11/1999 | Hsu | ..... | 30/519 |
| 6,446,341 | B1 * | 9/2002 | Wang et al. | ..... | 30/125 |
| 7,278,213 | B2 * | 10/2007 | Pardue et al. | ..... | 30/160 |
| 7,302,760 | B2 * | 12/2007 | Lake | ..... | 30/161 |
| 8,375,589 | B2 * | 2/2013 | Bremer et al. | ..... | 30/155 |
| 2004/0158991 | A1 * | 8/2004 | Freeman | ..... | 30/161 |
| 2009/0260234 | A1 * | 10/2009 | Lai | ..... | 30/161 |

* cited by examiner

*Primary Examiner* — Omar Flores Sanchez
(74) *Attorney, Agent, or Firm* — Hancock Hughey LLP

(57) ABSTRACT

In a folding knife in which a release button is used to lock the blade in the open and/or closed positions, and to release the blade from being locked, the release button has a dual tapered sidewall surface on the locking portion of the button.

18 Claims, 5 Drawing Sheets

DUAL TAPER RELEASE BUTTON FOR FOLDING KNIFE

FIELD OF THE INVENTION

This invention relates to folding knives that rely upon a release button to lock the blade in either the open or closed position, or both, and to release the blade when it is locked to move it from one position to another. More specifically, the invention relates to an improved release button for such knives that includes a tapered portion having two distinctly differently angled surfaces.

BACKGROUND

There are many types of knives, both automatic and manual, that utilize trigger-activated mechanisms that allow an implement to be moved between a folded position in which the implement is safely stowed in the tool handle, and an extended position in which the implement is ready for work. Of course, automatic versions of these knives include spring mechanisms that automatically drive the blade into the open position; manual knives require the blade to be moved manually from closed to open. The knife handle typically has two opposed handle portions defining a blade-receiving groove. A blade pivots on a shaft attached to the handle such that in a folded position the blade is stowed with the cutting portion of the blade safely in the groove, and such that in an extended position the blade is extended away from the handle, ready for use. The trigger mechanism controls movement of the blade from the closed to the open position—that is, when the blade is closed and the trigger is actuated, the blade may be moved either automatically or manually to the open position.

As noted, automatic opening knives include some kind of a spring-like or spring-driven mechanism that urges a blade from the closed position to the open position. In the closed position the blade must be locked against the constant opening force of the spring applied to the blade. Typical springs include spirally wound torsion springs that are wrapped around the pivot axis of the blade and which on one end engage the pivot pin, handle, liner or some other fixed, non-rotational structure, and on the other engage the blade. Other designs use compression springs and still others use extension springs and spiral wound flat springs and leaf springs. Many automatic opening mechanisms utilize or adapt the well-known sear type of design. Regardless of the particular mechanism used, when the locking mechanism is released, the spring forces the blade into the open position.

Preferably, push-button knives of the kinds described herein also include a locking mechanism that locks the blade in the open position. There are many designs for locking mechanisms to accomplish this task. Generally speaking, when the knife blade pivots into the open position, the blade's pivotal movement is stopped with a transverse blade stop pin housed in the handle. The locking mechanism is included to prevent the blade from pivoting back from the open into the closed position until the user purposefully closes the knife.

One common type of locking mechanism is a "liner lock." This kind of mechanism relies upon a resilient lever formed as part of a handle liner. When the blade is pivoted to the open or extended position, the resilient lever engages a cooperatively formed ramp on the blade and thereby locks the blade in the open position.

Two separate patents describe different types of automatic knives that use push-button release mechanisms: U.S. Pat. No. 5,822,866 and U.S. Pat. No. 7,278,213. Both of these patents are described briefly below. Both are owned by the assignee of the present invention and both are incorporated herein by this reference.

The automatic opening knife detailed in the '866 patent relies on a push button bolt mechanism that includes a locking body that has a cylindrically tapered side wall portion. When the blade is extended to the open position, the tapered side wall portion of the locking body is urged by a compression spring into a locking position in which the locking body wedges between an engagement surface on the blade and a bore in the handle to lock the blade in the open position.

The locking mechanism for automatic knives disclosed in U.S. Pat. No. 7,278,213 also relies upon a push-button type of bolt. The trigger mechanism has a bolt that extends transverse to the handle. When an exposed portion of the trigger mechanism is depressed the bolt moves laterally in the knife handle. Once the bolt clears the tang of the blade, the blade disengages from the bolt and is swung to the open position by a spring.

The release buttons, also known as lock buttons, or "bolts" described in the two patents just mentioned are critical components of the knives since they control the opening mechanisms, and also lock the blade in both the open and closed positions. The bolts are defined by a trigger button end that is exposed to the outside of the handle, a tapered locking end at the opposite end, which is housed internally in the handle, and a central, axial and cylindrical shaft or shank interconnecting the two ends. When the button end is pushed, the bolt moves laterally in the handle. As the bolt moves, the tang of the blade, which is driven rotationally by a coil spring, has enough clearance to move past the bolt because the central shank is relatively small in diameter, thereby allowing adequate clearance and allowing the blade to rotate to the open position. Once the blade is in the open position, its rotation having been stopped by a stop pin, the pressure on the bolt is released and the tapered locking end of the bolt engages a portion of the tang, thereby locking the blade in the open position and preventing movement of the blade to the closed position.

There is a need therefore for an improved and more robust release button mechanism for use in a knife that relies upon a push button type of release and locking mechanism.

The present invention relates to an improved design for a release button or bolt for use in a push-button type release folding knife, in which the button serves to control the locking/opening mechanism, and to lock the blade in either the open or closed positions, or both positions.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF THE PREFERRED EMBODIMENTS

The present invention relates to a release button for use in manual folding knives. The release button functions as a lock button, since it locks the blade in both the open and closed positions.

Figure 1:
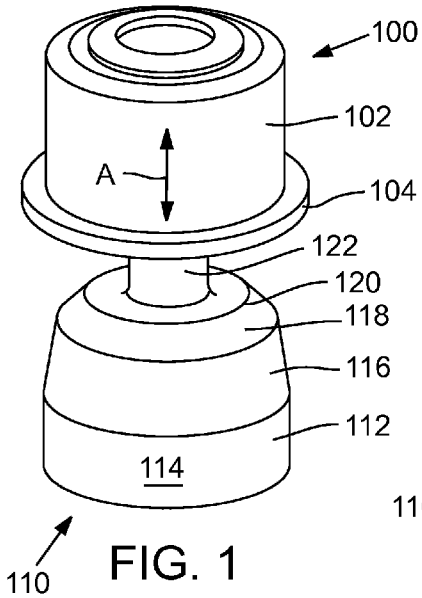
FIG. 1 is a side elevation view of a release button according to the present invention illustrating the dual angled tapered section, shown in isolation.
Figure 2:
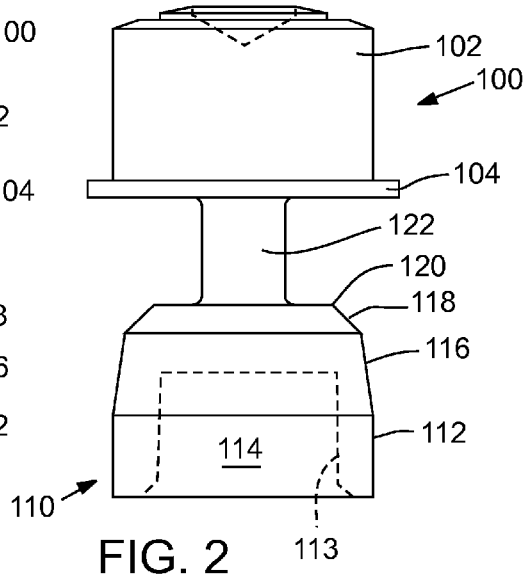
FIG. 2 is a top perspective view of the release button shown in FIG. 1.
Figure 3:
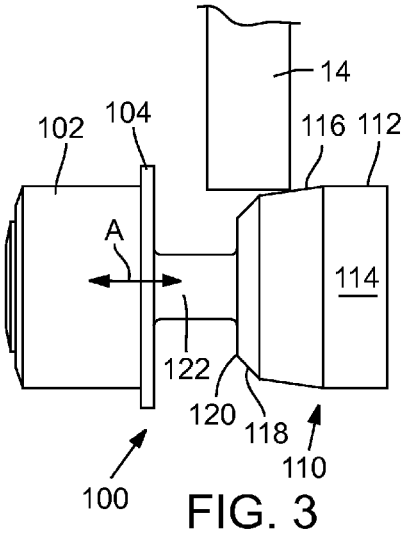
FIG. 3 is a side elevation view of the release button according to the present invention showing the release button in isolation with a portion of the blade of a knife (or other tool) and illustrating the relative positional relationship between the release button and the blade when the blade is in the open (i.e., extended) and locked position.
Figure 4:
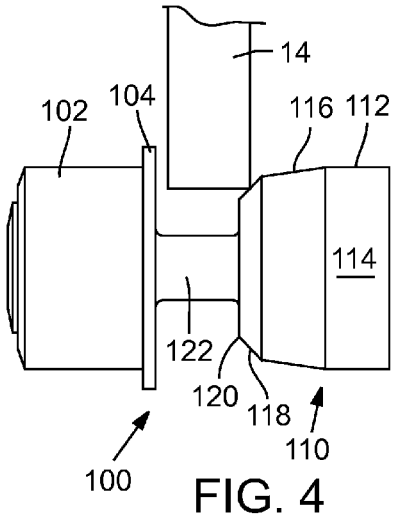
FIG. 4 is a side elevation view of the release button according to the present invention showing the release button in isolation with a portion of the blade of a knife (or other tool), similar to FIG. 3, but illustrating the relative positional relationship between the release button and the blade when the blade is in the closed position.
Figures 5, 6:
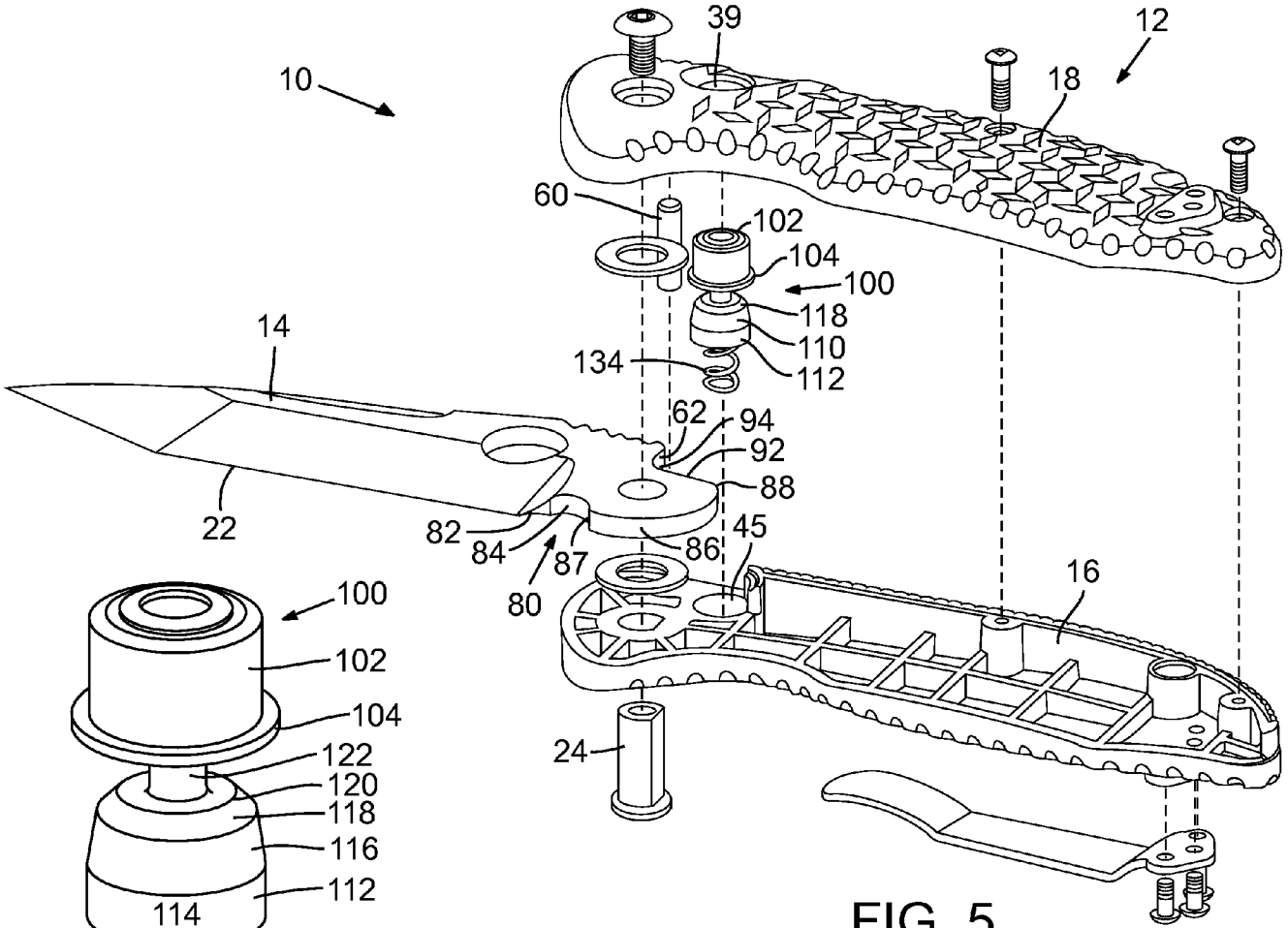
FIG. 5 is an exploded perspective view of an exemplary knife into which the release button of FIG. 1 is incorporated, illustrating the component parts.
FIG. 6 is a perspective view of the release button according to the present invention.

A preferred embodiment of the release button according to the present invention is shown in the figures and is identified with reference number 100. Release button 100 may alternately be referred to as a "bolt", or a "release pin". The release button 100 is spring-loaded and extends in a transverse direction between handle halves 16 and 18 of knife 10, parallel to shaft 24 (FIG. 5). The release button 100 comprises three separately identifiable structural features that together define the bolt: a button end, a locking end, and a shank that interconnects the two ends. As detailed herein, the release button serves dual functions. Thus, it serves to release the blade so that the blade may be moved between the open and closed positions. Second, it serves to lock the blade in both the open and closed positions. As such, the release button 100 may aptly be called a release/lock bolt. The linear direction of travel of release button 100 in knife 10 is shown with arrow A in FIG. 1, and may be seen to be substantially transverse to the longitudinal axis defined by the knife handle and blade.

The first structural feature of release button 100 is a button end 102 that is at the proximate end of the button and which is exposed out of handle half 18 in the assembled knife (FIG. 5) and which is operable by a user to open the knife. A flange 104 having a diameter greater than the diameter of button end 102 extends radially around the base of the button end 102 and functions to retain the release button housed in the assembled knife.

The second structural feature of release button 100 is the end of the bolt opposite of button end 102, on the distal end of the bolt, which defines a locking body 110. Locking body 110 has a large diameter portion 112 on the distal end of the locking body that has side walls 114 that are planar and parallel to the linear direction of motion of the release button as defined with arrow A. The planar side walls 114 are a reference surface used herein to describe the tapered portions of the locking body 110. Immediately adjacent the larger diameter portion 112 is a first tapered sidewall portion 116. The diameter of tapered sidewall portion 116 decreases gradually from the relatively larger diameter portion defined by larger diameter portion 112 to a junction with a second tapered sidewall portion identified by reference number 118. Second tapered sidewall portion 118 is angled at a greater angle than first tapered sidewall portion 116 relative to the side walls 114. Second tapered sidewall portion terminates at an edge portion 120. Locking body 110 has a hollow base 130.

The third structural feature of release button 100 is a shank 122 that interconnects button end 102 to locking body 110. The shank 122 is defined by a cylindrical portion that connects the button end 102 to the locking body 110 along the axial centerline through the release button 100.

Release button 100 is preferably fabricated from a strong metal so it can withstand the rigors of repeated use, and preferably is monolithic. The bolt may be formed in any appropriate manner, for example by machining, molding or casting.

Figure 13:
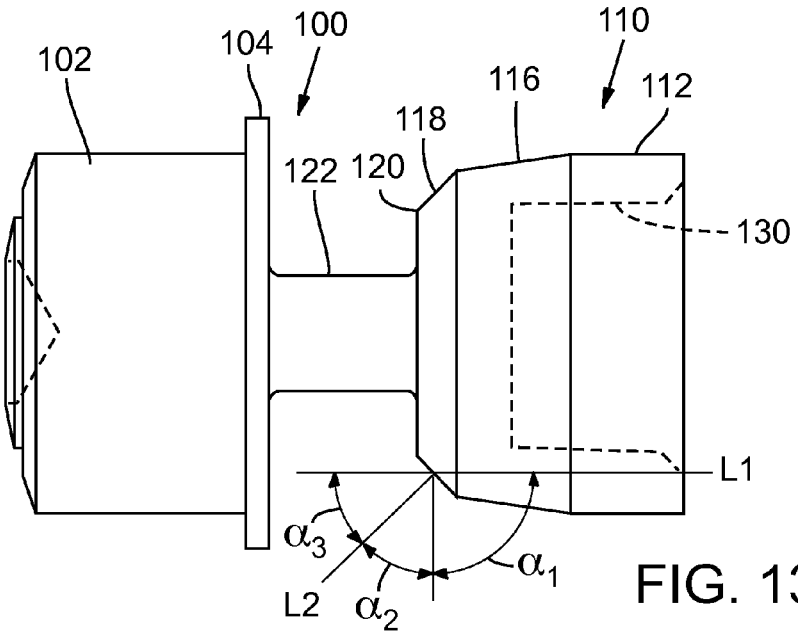
FIG. 13 is a close up elevation view of the release button in isolation, illustrating the angular relationships and force vectors associate with the blade when the blade is in the closed position.

The relative angular relationships of the two tapered and angled sidewall portions—first tapered sidewall portion 116 and second tapered sidewall portion 118—are best seen in FIGS. 3, 4, 13 and 14. Specifically, the second tapered sidewall portion 118 is formed at an angle of between about 45 degrees to about 65 degrees relative to the sidewall defined by 114, which as noted previously is parallel to the axis of travel defined by arrow A. In FIG. 13 the angular relationship between sidewall 114 and second tapered portion 118 is illustrated as the angle $\alpha_2$, and the angular relationships are discussed below.

Figure 14:
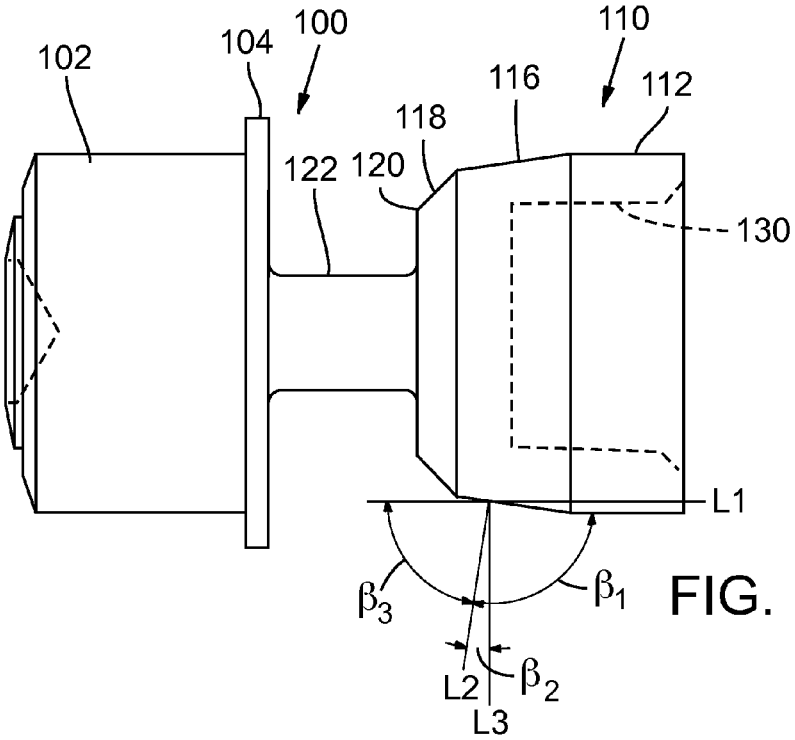
FIG. 14 is a close up elevation view of the release button in isolation, illustrating the angular relationships and force vectors associate with the blade when the blade is in the open position.

The first tapered sidewall portion 116 is angled at a relatively lesser angle relative to 114. In FIG. 14 the angular relationship between sidewall 114 and first tapered portion is illustrated as the angle $\beta_2$, which is between about 7.5 degrees to about 20 degrees relative to the sidewall defined by 114.

A embodiment of release button 100 incorporated into a knife 10 is shown in exploded view in FIG. 5. It will be appreciated that the knife 10 in FIG. 5 does not include all components. Although the invention is described with respect to a particular style of knife, it will be appreciated that references to this style of a knife, are for illustrative purposes to describe the invention. Those of ordinary skill in the art will appreciate that the invention claimed herein is not limited to knives, but instead extends to any hand tool having the features claimed herein.

With reference to FIG. 5, knife 10 includes a handle 12 and a blade 14. Handle 12 includes two side wall portions or halves 16 and 18 that are held parallel to one another in a spaced apart relationship with various screws and the like (some of which are illustrated) to define a blade receiving groove between the handle halves. Handle 12 defines a longitudinal body axis. Blade 14 is pivotally attached to handle 12 near the "forward" end of handle 12 with a pivot shaft 24 that is transverse to the longitudinal body axis, and which has its opposite ends fixed to the handle halves 16 and 18. When the blade 14 is in the retracted or closed position, the working or sharp portion 22 of the blade is safely stowed in the blade receiving groove between the handle halves. As a linguistic convention, relative directional terms used herein correspond to the geometric center of the knife and how the knife is used in normal usage conditions. Using this convention, the front or forward of the handle is where pivot shaft 24 extends through the handle. The "rear" or butt end of the handle is opposite the forward end; the "upper" part of the blade is the dull, non-working portion and the "lower" portion of the blade is the sharpened, working portion. "Inner" or "inward" refers to the geometric center of the knife 10; the "forward" end of blade 14 is its tip, and so on.

Figure 11:
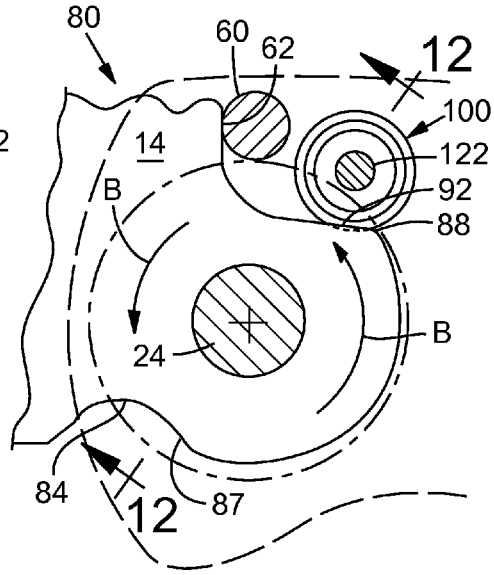
FIG. 11 is a partially schematic view of portions of a knife such as the knife in FIG. 5, analogous to FIG. 9, but illustrating the rotational path of the blade as it moves from the open to the closed position.

A blade stop pin 60 extends parallel to pivot shaft 24 and has its opposite ends fixed in the handle halves 16 and 18, respectively, with for example a screw. When the blade 14 is in the open position shown in FIG. 5, a shoulder 62 formed on blade 14 abuts stop pin 60 to thereby stop rotational movement of blade 14. This is best shown in FIG. 11. The position of blade 14 when shoulder 62 abuts stop pin 60 is defined as the stop position—that is, the fully open position. When shoulder 62 abuts stop pin 60 the blade 14 is locked in this open position by the action of release button 100, as detailed below.

Figure 8:
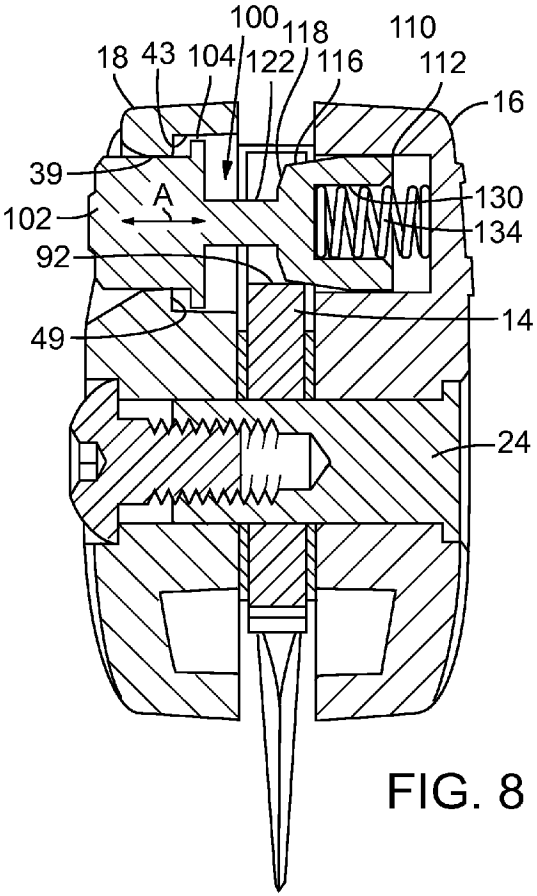
FIG. 8 is a cross sectional view of the knife similar to the view of FIG. 7, except showing the blade in the open and locked position.
Figure 7:
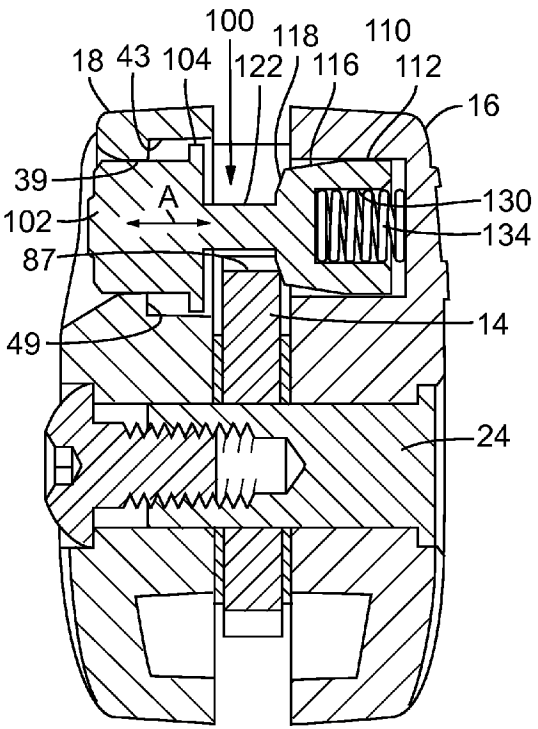
FIG. 7 is a cross sectional view of the knife of FIG. 5 (assembled), taken through the pivot pin of the knife, showing the blade in the closed position and the release button in the detent position.

As best shown in FIGS. 5, 7 and 8, in the assembled knife, the locking body 110 of release button 100 is received in cylindrical, dead-end cavity 45 formed in handle half 16 with a compression spring 134 received in the hollow base 130 in the distal end of locking body 110. The diameter of cavity 45 is slightly greater than the diameter of locking body 110 measured at the relatively larger diameter portion 112. This allows the bolt to move in an up and down fashion in the cavity, as shown with arrow A. The opposite end of release button 100, that is, the proximate or button end 102 extends through a bore 39 in handle half 18 such that the button end is exposed to the exterior of the knife 10. Inwardly of bore 39 and axially communicating with bore 39 is an interior bore portion in handle half 18 that is identified with reference number 43. The diameter of bore 43 is slightly larger than the diameter of flange 104. The diameter of bore 39 is less than the diameter of bore 43, defining a lip 49. The diameter of bore 39 at lip 49 is smaller than the diameter of flange 104. Release button 100 is retained in handle 12 with the flange 104 positioned interiorly of bore 39, and as such, release button 100 is retained in the handle and cannot be removed from the handle by virtue of the flange 104. The spring 134 resides in the cavity 45 and in the hollow base 130 of the locking body and at all times urges release button 100 away from handle half 16.

Figure 9:
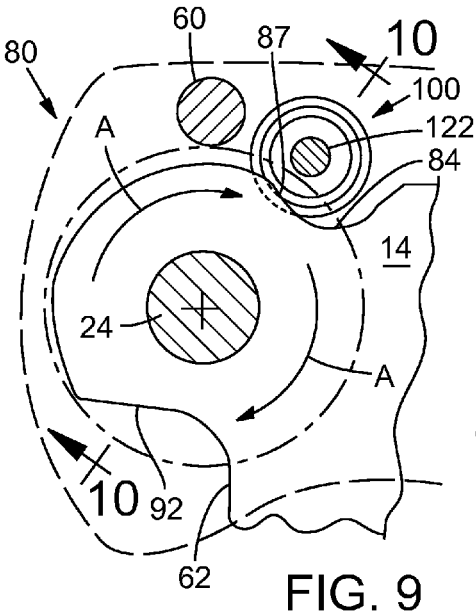
FIG. 9 is a partially schematic view of portions of a knife such as the knife in FIG. 5, illustrating the rotational path of the blade as it moves from the closed to the open position.

The tang 80 of blade 14 will now be described in detail with particular reference to FIGS. 5, 9 and 11. With reference to FIG. 5, the description of tang 80 will begin with sharpened edge 22 of blade 14 and will trace the edge 86 of tang 80 in a counterclockwise direction. Sharpened edge 22 of blade 14 terminates at a shoulder 82. Adjacent and rearward of shoulder 82 edge 86 defines a first semi-circular notch 84. The edge 86 of tang 80 continues in a curved path until a shoulder 88, at which point the edge of the tang turns inwardly in the general direction toward pivot shaft 24, at about a 90 degree angle, thereby defining a flattened face 92. Continuing in the same counterclockwise direction, the edge 86 curves generally outwardly to define a second semi-circular second notch 94 that is located generally opposite notch 84, and continues to shoulder 62, which abuts stop pin 60 when the blade is in the open position shown in FIG. 1.

Figure 10:
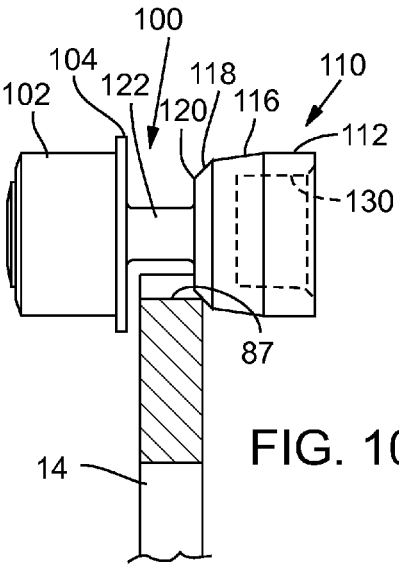
FIG. 10 is an elevational view showing the release button and a portion of the blade (shown in partial sectional view) illustrating the blade in the closed position.

Turning now to FIGS. 9 through 12, when blade 14 is in the closed position with the blade stowed in slot 20 in handle 12, button 100 operates to retain the blade in this position. The force that drive the blade from closed to open exerts rotational pressure on blade 14 in the direction of arrow A in FIG. 9. With specific reference to FIG. 10, the blade 14 is locked in this closed position with the second tapered sidewall portion 118 of locking body 110, which wedges between and engages a locking surface 87 on blade 14, which is defined by the notch 84 in tang 80. In FIG. 10, the locking surface 87 is at about the 7:00 position using the circular release button 100 as the reference clock face. Spring 134 urges release button 100 into its fully extended position—that is, the position in which flange 104 abuts the lip 49 between bores 39 and 43 in handle half 18. In this position, second tapered sidewall portion 118 is wedged against the locking surface 87 on blade 14. The relative angular relations of the locking surface 87 relative to the second tapered sidewall portion 118 is shown in FIG. 10, and as detailed below, in FIG. 13, and thereby preventing the blade from moving from the closed to the open position. The blade 14 is held in this closed position (again, preferably with a safety mechanism) until the trigger mechanism is activated—that is, until release button 100 is depressed by the user.

The trigger mechanism defined by release button 100, which allows blade 14 to be rotated to the open position (arrow A in FIG. 1) is actuated by pushing button end 102 of release button 100 inwardly against the force of the compression spring 134 (see arrow A in FIGS. 7 and 8), which as described above always exerts a spring force urging release button 100 into the position shown in FIG. 7. Since the overall length of release button 100 is less than the width of handle 12 measured in bore 43, the release button is movable in the bore in an up and down fashion. Pushing button end 102 so that release button 100 moves inwardly causes the locking body portion 110 of release button 100—that is, second tapered sidewall portion 118, to disengage from the notch 84 in tang 80 of blade 14. When the release button 100 is depressed far enough so that edge 120 of release button 100 passes by edge 86 of tang 80, blade 14 is free to rotate and is pivotally movable toward the open position—the tang portion of blade 14 passes in the passageway between button ends 102 and locking body 110 of release button 100.

It will be appreciated that the release button 100 is configured to reside in three functional positions. The first position is called the "detent" position and this position is shown in FIG. 7 with the blade in the closed position and the release button locking the blade in this position. In the detent position the lockup between the blade and the release button is with the blade making contact with the second tapered sidewall portion 118. Since the detent position is a position where the release button locks the blade (in the closed position), this is a position where the button will remain stationary for storage of the knife.

The second release button position is the blade opening and closing position, and occurs when the user pushes the release button all of the way into the handle such that the blade is free to rotate from closed to open, and open to closed, and thus the tang of the blade rotates in the passageway defined between flange 104 and edge portion 120. This second position can only be maintained with the user actively depressing the release button.

The third release button position is the blade open and locked position that is shown in FIG. 8 with the blade in the open position and the release button locking the blade in this position. In this third position the lockup between the blade and the release button is with the blade making contact with the first tapered sidewall portion 116. Since the third release button position is a position where the release button locks the blade (in the open position), this is a position where the button will remain stationary for while the knife is being used.

Figure 12:
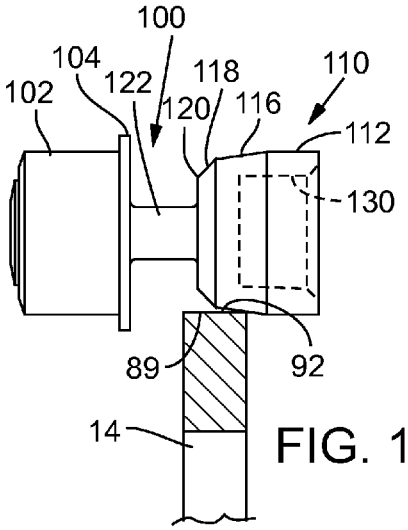
FIG. 12 is an elevational view showing the release button and a portion of the blade (shown in partial sectional view), analogous to FIG. 10, but illustrating the blade in the open and locked position.

With reference now to FIGS. 11 and 12, rotation of blade 14 as it moves from the closed position to the open position is stopped when shoulder 62 of tang 80 abuts blade stop pin 60—the blade is rotated in the direction of arrow B in FIG. 11. When the blade is in the open position, the inward pressure on button release button 100 may be released, allowing the release bolt to once again assume the position shown in 8 under force applied to the bolt by spring 134. In this position, the first tapered sidewall portion 116 of release button 100 wedges against the face 92 of tang 80, which defines a second locking surface 89 on the tang of blade 14. As best shown in FIG. 11, the corner of tang 80 defined at shoulder 88 does not make contact with the release button 100. Instead, the point of contact between the release button 100 and tang 80—the lockup point—second locking surface 89—is on the flattened face 92 at about the 6:00 o'clock position, again relying upon the circular bolt as the reference clock face. This lockup defines a compressive force between the first tapered sidewall portion 116 and the tang when blade 14 is forced against the lockup in the direction illustrated by the arrow B in FIG. 11.

Reference is now made to FIGS. 13 and 14, in which the line labeled L1 is a reference line that is parallel to the linear direction of movement of release bolt 100 in assembled knife 10 (i.e., arrow A, FIG. 1), and parallel to the sidewall portion 114 at the distal end of locking body 110. The angle labeled $\alpha_1$ in FIG. 13 is the angle between reference line L1 and reference L2, which is a line normal to second tapered sidewall portion 118, and is preferably between about 115 degrees to about 135 degrees—accordingly, it is evident that second tapered sidewall portion 118 is angled inwardly relative to reference line L1 at an angle, preferably between about 45 and 65 degrees—as shown with angle $\alpha_2$ in FIG. 13 (and the supplementary angle $\alpha_3$ is between about 45 and 65 degrees). Reference line L3 is a line normal to L1.

In FIG. 14 the angle labeled $\beta_1$ is the angle between reference line L1 and reference L2, which is a line perpendicular to L1. Angle $\beta_2$ is the angle between L2 and L3, which is a line normal to first tapered sidewall portion 116, and is preferably between about 7.5 degrees and 20 degrees (that is, first tapered sidewall portion 116 is angled inwardly relative to reference line L1 at an angle of between about 7.5 degrees and 20 degrees). And supplementary angle $\beta_3$ is between about 70 and 82.8 degrees. Reference line L3 is a line normal to L1.

The differences in the relative angles between the first and second tapered sidewall portions 116 and 118, respectively, have significant functional and structural purposes. When blade 14 is in the closed position and release button 100 is in the position shown in FIGS. 4, 7, 9 and 10 (as noted previously, called the "detent position"), the force vector applied by blade 14 to the locking body 100 is substantially normal to second tapered sidewall portion 118, as shown by line L2 in FIG. 13. Because any rotational force applied to the blade 14 when it is closed is relatively minor—the shear force applied against the locking body by the blade, as defined by the vector represented by line L2, tends to translate into making movement of the release button easier. Said another way, the vector force applied is greater along line L1 than L2.

However, when blade 14 is in the open position as represented in FIG. 14, substantially greater rotational force may be applied against the blade tending to drive the blade from the open to the closed position, as for example when the knife is in normal use. In this case, the blade is in contact with the first tapered sidewall portion 116 and the taper angle translates the force primarily into shearing force—the L3 direction and represented by line L3—with minimal force translated in the L1 direction. This results in a strong locking position. Thus, the vector force represented by L3 is greater than L1.

It will be understood that the release button 100 as described herein and as shown in the drawings provides significant advantages in the process of manufacturing knives, and especially in blade fabrication. More specifically, the overall number of process steps used to manufacture blades may be significantly reduced, simplifying the manufacturing process and reducing costs. Even more specifically, blades appropriate for use with the release button 100 described herein may be fabricated with 2D forming with laser cutting, stamping, blanking, and water jet cutting; no milling or grinding is necessary to create the closed detent.

It will be appreciated that certain modifications may be made to the release button 100 without changing the principals of the invention. For example, the relative angles of first and second tapered sidewall portions may be varied. Further, although release button 100 and shank 122 are illustrated as being cylindrical, these and other components of the bolt could be of many other different geometric configurations. As another example, the release button 100 is shown as being retained in the handle 12 by virtue of flange 40. However, there are many equivalent structures that may be used to retain the bolt in the handle. Finally, while a monolithic bolt is preferred for its strength, an equivalent component may be fabricated in multiple pieces.

While the present invention has been described in terms of a preferred embodiment, it will be appreciated by one of ordinary skill that the spirit and scope of the invention is not limited to those embodiments, but extend to the various modifications and equivalents as defined in the appended claims.

I claim:

1. A release button for a knife having a folding knife blade, comprising:

an elongate body having a user actuated end, a blade locking end, and a shank interconnecting the user actuated end and the blade locking end, wherein the blade locking end includes a first angled portion for locking the knife blade in a closed position, and an adjacent second angled portion for locking the knife blade in the open position.

2. The release button according to claim 1 wherein the first angled portion defines a surface having a greater degree of slope relative to a reference plane than the second angled portion.

3. The release button according to claim 2 wherein the release button is linearly movable along an axis, and wherein the reference plane is parallel to the axis.

4. The release button according to claim 2 in which the blade locking end includes a third body portion that has sidewalls that are parallel to the reference plane.

5. The release button according to claim 1 wherein the knife blade is movable between an open and locked position and a closed position, and wherein when the blade is in the open and locked position the blade makes contact with the second angled portion.

6. The release button according to claim 5 wherein when the blade is in the closed position the blade makes contact with the first angled portion.

7. The release button according to claim 6 wherein the blade includes a tang having a first shoulder that makes contact with the second angled portion when the blade is in the open and locked position.

8. The release button according to claim 6 wherein the tang includes a second shoulder that makes contact with the first angled portion when the blade is in the closed position.

9. The release button according to claim 8 including a lock for securing the blade in the closed position.

10. The release button according to claim 3 wherein the first angled portion is oriented at an angle of between about 40 and 65 degrees relative to the reference plane.

11. The release button according to claim 3 wherein the second angled portion is oriented at an angle of between about 7.5 and 20 degrees relative to the reference plane.

12. A release button for a knife having a folding knife blade, comprising:

an elongate body having an axis and having a proximate end, a distal end, and a shank interconnecting the proximate and distal ends, wherein the distal end is defined by a first sidewall portion with sidewalls parallel to the axis, a second sidewall portion with sidewalls oriented at a first angular orientation relative to the axis, and a third sidewall portion with sidewalls oriented at a second angular orientation relative to the axis;

wherein the second sidewall portion is oriented at a lesser angle relative to the axis than the angle of the third sidewall portion relative to the axis; and wherein the knife blade is foldable in a knife handle between an open position and a closed position, and wherein when the knife blade is in the open position the knife blade abuts the sidewall of the second sidewall portion to thereby lock said knife blade in the open position.

13. The release button according to claim 12 in which when the knife blade is in the closed position the knife blade abuts the sidewall of the third sidewall portion to thereby lock said knife blade in the closed position.

14. The release button according to claim 13 wherein the sidewalls of the second sidewall portion are oriented at an angle of between about 40 and 65 degrees relative to the axis.

15. The release button according to claim 14 wherein the sidewalls of the third sidewall portion re oriented at an angle of between about 7.5 and 20 degrees relative to the axis.

16. A release button for a knife having a having a blade foldably attached to a knife handle and the blade foldable between an open position in which a working portion of the blade is extended away from the handle exposed and a closed position in which the working portion of the blade is at least partially housed in the handle, the handle of the knife defining a longitudinal handle axis, the release button comprising:

an elongate body having a longitudinal body axis and retained in the knife handle such that the longitudinal body axis is substantially transverse to the longitudinal handle axis, said elongate body reciprocally movable along the longitudinal body axis between a blade locking position and a blade moving position, said elongate body having a proximate end that defines a user actuated portion, a cylindrically shaped distal end that defines a blade locking portion, and a shank interconnecting the proximate and distal ends, wherein the distal end is defined by a first cylindrical sidewall portion with sidewalls that are parallel to the longitudinal body axis, a second cylindrical sidewall portion with sidewalls that define a plane oriented at a first angular orientation relative to the longitudinal body axis, and a third cylindrical sidewall portion with sidewalls that define a plane oriented at a second angular orientation relative to the longitudinal body axis, and wherein when the blade is in the open position and the elongate body is in the blade locking position, the blade abuts the second cylindrical sidewall portion and when the blade is in the closed position and the elongate body is in the blade locking position the blade abuts the third cylindrical sidewall portion.

17. The release button according to claim 16 in which when the blade is in the closed position and the elongate body is in the blade locking position, the blade exerts a vector force to the third cylindrical sidewall portion in a direction substantially normal to the plane defined by the third cylindrical sidewall portion.

18. The release button according to claim 16 movable between three operating positions, each of the three operating positions defined by the release button located in a different position relative to the handle, wherein in the first position the blade is in the closed position, in the second position the blade is in the open and locked position, and in the third position the blade is movable from the closed to the open position.

* * * * *